US005812164A

United States Patent [19]

Bowling

[11] Patent Number: 5,812,164

[45] Date of Patent: Sep. 22, 1998

[54] INSTANT RESONATOR POSITION LOCK

[75] Inventor: Bruce A. Bowling, Beavercreek, Ohio

[73] Assignee: Scitex Digital Printing, Inc., Dayton, Ohio

[21] Appl. No.: 605,942

[22] Filed: Feb. 23, 1996

[51] Int. Cl.[6] ..... B41J 2/02

[52] U.S. Cl. ..... 347/75

[58] Field of Search ..... 347/73, 74, 75, 347/89, 20, 68, 70; 29/890.1

[56] References Cited

U.S. PATENT DOCUMENTS 4,196,271 4/1980 Yamada et al. ..... 525/242
4,303,927 12/1981 Tsao ..... 347/75 X
4,937,589 6/1990 Fagerquist et al. ..... 347/75
5,475,409 12/1995 Simon et al. ..... 347/74
5,477,254 12/1995 Stephens ..... 347/74
5,539,982 7/1996 Hosono et al. ..... 29/890.1

*Primary Examiner*—Edward Tso
*Attorney, Agent, or Firm*—Barbara Joan Haushalter

[57] ABSTRACT

An apparatus is provided for locking an ink jet resonator assembly into a printhead of a continuous ink jet printer. The locking apparatus comprises a resonator holder for holding the resonator prior to alignment of the resonator assembly; a frame for supporting the resonator holder and the resonator assembly after alignment; and a methyl-cyanoacrylate adhesive applied between the resonator holder and the frame to lock into position the properly aligned resonator assembly.

10 Claims, 1 Drawing Sheet

INSTANT RESONATOR POSITION LOCK

TECHNICAL FIELD

The present invention relates to continuous ink jet printers and, more particularly, to locking the position of a resonator after achieving the desired assembly relationship.

BACKGROUND ART

Ink jet printing systems are known in which a print head defines one or more rows of orifices which receive an electrically conductive recording fluid, such as for instance a water base ink, from a pressurized fluid supply manifold and eject the fluid in rows of parallel streams. Printers using such print heads accomplish graphic reproduction by selectively charging and deflecting the drops in each of the streams and depositing at least some of the drops on a print receiving medium, while others of the drops strike a drop catcher device.

An existing assembly method for assembling the components of an ink jet print head includes locating the droplet generator with the aid of an assembly fixture, then using an epoxy or similar adhesive to fasten it into place. The charge plate/catcher assembly was then aligned to the droplet generator through the use of external adjustment fixtures. Once a proper alignment was achieved, the charge plate/catcher assembly was fastened with screws to the common frame holding the droplet generator.

Unfortunately, use of epoxy in existing assembly and alignment methods has had some drawbacks. For instance, the use of epoxy increases assembly cycle time, since it takes several hours for the epoxy to cure. The use of epoxy is also problematic in that it is temperature and humidity sensitive. Finally, the sensitivity of the alignment is such that even after final fastening of a charge plate/catcher assembly, realignment is often required.

Other problems also exist with current alignment and holding schemes. For example, each part must be installed, adjusted and qualified. As each part is assembled, it refines serially the six degrees of freedom that must be accounted for when building and holding a resonator or droplet generator. During the serial refinement of the six degrees of freedom, the actual hardware is a combination of plates and screws built into the printhead that are stressed until alignment is achieved. This stress remains on the hardware after final assembly and makes the alignment suspect of shifts during shipping and use of the product.

Other disadvantages with current holding techniques for droplet generator or resonator assemblies include holes being bored through the generator or resonator body. Dowel pins or tubes are then pressed into these holes with an instant adhesive. The ends of the pins or tubes are strapped down with steel plates and screws into a yoke or holder. One problem is that through holes in a droplet generator or resonator negatively affect stimulation, which is a critical performance feature. Finally, existing holding techniques for such assemblies use large forces to hold the pins/tubes in the yoke, which over-constrains the assembly by bending the pins and straps.

It is seen then that there is a need for an improved apparatus for holding and locking an ink jet resonator assembly into a printhead, after a desired alignment has been achieved, which overcomes the problems associated with existing techniques, including reducing labor and material costs.

SUMMARY OF THE INVENTION

This need is met by the system according to the present invention, wherein a methyl-cyanoacrylate adhesive is used to lock the position of the resonator in an ink jet printing system, once the desired assembly relationship has been achieved.

In accordance with one aspect of the present invention, an apparatus is provided for locking an ink jet resonator assembly into a printhead of a continuous ink jet printer. The locking apparatus comprises a resonator holder for holding the resonator prior to alignment of the resonator assembly; a frame for supporting the resonator holder and the resonator assembly after alignment; and a methyl-cyanoacrylate adhesive applied between the resonator holder and the frame to lock into position the properly aligned resonator assembly.

The locking assembly according to the present invention provides a variety of advantages. First, the locking means of the present invention reaches an acceptable handling level in seconds, as opposed to hours for epoxies. In addition, since the assembly is held in a stress free environment, with no screws to induce tension, compression, or torsional stresses, the chances of movement are remote. Finally, the technique of the present invention reduces parts count from approximately twenty-six parts in existing alignment and holding mechanisms, to three parts, thereby reducing labor and material costs.

Other objects and advantages of the invention will be apparent from the following description, the accompanying drawings and the appended claims.

DETAILED DESCRIPTION OF THE PREFERRED EMBODIMENTS

Figure 1:
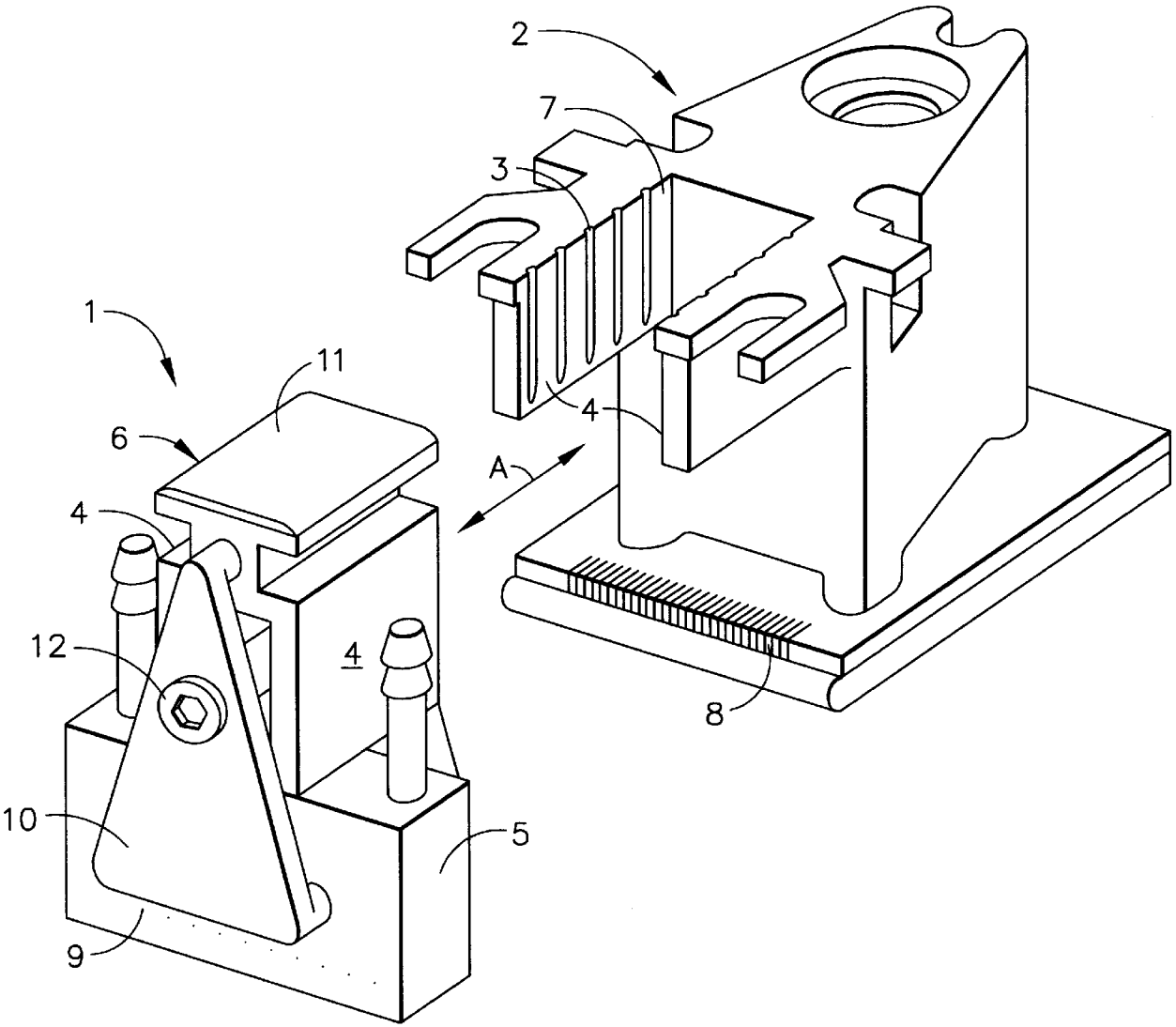
FIG. 1 is an exploded view illustrating the interrelationship of the components of the locking apparatus according to the present invention.

The present invention provides a means for locking a resonator into position in a droplet generator assembly of a continuous ink jet printer. The locking apparatus of the present invention allows for six degrees of freedom of adjustment, including three degrees of freedom of translation and three degrees of freedom of rotation. The first degree of freedom of translation comprises a height adjustment of the resonator relative to the charge plate; the second degree of freedom of translation comprises an alignment adjustment for aligning the plurality of jets with respect to the plurality of charge leads; and the third degree of freedom of translation comprises a reciprocal adjustment for moving the plurality of jets relative to the face of the charge plate. In the apparatus of the present invention, the first degree of freedom of rotation comprises a first parallel adjustment for aligning the plurality of jets parallel to the charge plate face; the second degree of freedom of rotation comprises a second parallel adjustment for aligning the array of orifices parallel to the charge plate face; and the third degree of freedom of rotation comprises a third parallel adjustment for aligning the orifice plate parallel to the top of the charge leads.

The design of the present invention moves all of the built-in alignment features, which add hardware, to external tooling that is not part of the product. Once alignment is achieved, the parts are "frozen" in free space using a methyl-cyanoacrylate adhesive.

Referring now to FIG. 1, there is illustrated an exploded view of the interrelationship of the components of the locking apparatus according to the present invention. In accordance with the present invention, a methyl-cyanoacrylate adhesive is applied between a resonator/ droplet generator holder 1 and a frame 2, to lock into position a properly aligned resonator assembly 5. The resonator holder 1 holds the resonator 5 in place, before locking the resonator assembly into position. The resonator holder 1 preferably comprises a mounting apparatus such as is described and claimed in co-pending, commonly assigned patent application, Ser. No. 08/606,427 (docket Number SDP140PA), totally incorporated herein by reference. The resonator holder, or mounting apparatus, preferably comprises a resonator clamping plate 10 for mating to one side of the resonator 5 and a resonator support 11 for mating with the opposing side of the resonator 5. A holding force, such as a socket head cap screw 12, securely holds the resonator, the resonator clamping plate, and the resonator support, to comprise the resonator holder 1. The frame 2 supports the resonator/droplet generator holder 1, parallel surfaces 4, and resonator assembly 5 after alignment.

Continuing with FIG. 1, initially, a "T" shape portion 6 of the holder 1 is held to external tooling (not shown). Holder 1 and frame 2 are then movable toward each other in the direction of arrow A to place holder 1 within a yoke area 7 of frame 2. In a preferred embodiment of the present invention, the clearance between parallel surfaces 4 of holder 1 and frame 2 can have a clearance no greater than a statistical 0.004". Surface finish on these areas must be between 60 and 160 RMS with a particulate pattern.

Once the walls 4 become the joining or common areas in the methyl-cyanoacrylate bonding process, assembly of holder 1 and frame 2 can be manipulated or aligned before application of the locking means, or methyl-cyanoacrylate. Once proper alignment is achieved, the methyl-cyanoacrylate adhesive is applied to capillary channels 3. The adhesive wicks down the channels and out to adjacent walls 4, to freeze the parts together, typically within 15 seconds. With the "frozen" assemblies held in a stress free environment, the chances of movement are remote. Even the weight between holder 1 and frame 2 are in shear, which is the strongest axis to a methyl-cyanoacrylate joint. In a preferred embodiment of the present invention, the methyl-cyanoacrylate has a low viscosity to enable the bonding agent to wick down the 0.004" gap. Consequently, the methyl-cyanoacrylate has a centipose no greater than 150.

Alignment between catcher/charge plate assembly (which includes charge plate face 8), and the resonator/droplet generator assembly (which includes jets or orifices 9), allows for six degrees of freedom of adjustment. The six degrees of freedom of adjustment comprise first, second and third degrees of freedom of translation, and first, second and third degrees of freedom of rotation. The six degrees of freedom can be freely translated. Furthermore, the six degrees of freedom can all be simultaneously frozen into position.

Although the preferred mode of practicing the invention has been described with reference to an ink jet print head for a continuous ink jet printer, the principle of the present invention can also be applied to a wide variety of ink jet printers.

Industrial Applicability and Advantages

The locking apparatus according to the present invention is useful in continuous ink jet printers. The apparatus allows for six degrees of freedom of adjustment of critical alignment parameters. Once the proper alignment has been achieved, the assembly of the holder and the resonator assembly to the yoke and particulate areas of the frame are "frozen" in free space using methyl-cyanoacrylate adhesive. The parallel surfaces become the joining areas in the bonding process. One advantage provided by the use of methyl-cyanoacrylate is that it reaches an acceptable handling level in approximately 15 seconds, as opposed to epoxies which can take up to 48 hours. Furthermore, methyl-cyanoacrylate adhesives demand thin bond lines which mean extremely small shrinkage associated with the curing cycle; whereas epoxies tend to use large bond lines and have a much higher dimensional displacement from shrinkage. Finally, disassembly of cyanoacrylate adhesives is achieved simply with a solvent or slightly elevated temperature; whereas epoxies require extreme heat or grinding of material to remove.

Having described the invention in detail and by reference to the preferred embodiment thereof, it will be apparent that other modifications and variations are possible without departing from the scope of the invention defined in the appended claims.

I claim:

1. A locking apparatus for locking an ink jet resonator assembly, including a resonator, into a printhead of a continuous ink jet printer, the locking apparatus comprising:

a resonator holder for holding the resonator the resonator holder comprising, a resonator clamping plate for mating with one side of the resonator, a resonator support for mating with an opposing side of the resonator, and a holding force to securely hold the resonator, the resonator clamping plate, and the resonator support;

a frame for supporting the resonator holder and the resonator assembly in alignment; and a methyl-cyanoacrylate adhesive applied between the resonator holder and the frame to lock into position the properly aligned resonator assembly.

2. A locking apparatus as claimed in claim 1 wherein the resonator holder comprises a first parallel surface.

3. A locking apparatus as claimed in claim 2 wherein the resonator frame comprises a second parallel surface having a plurality of capillary channels.

4. A locking apparatus as claimed in claim 3 wherein the first parallel surface aligns with the second parallel surface during locking.

5. A locking apparatus as claimed in claim 4 wherein the methyl-cyanoacrylate is applied to the plurality of capillary channels to freeze the resonator holder to the frame along the first and second parallel surfaces.

6. A locking apparatus as claimed in claim 1 wherein the methyl-cyanoacrylate adhesive comprises a cyanoacrylate having a centipose less than or equal to 150.

7. A method for locking an ink jet resonator assembly, including a resonator, into a printhead of a continuous ink jet printer, the method comprising the steps of:

providing a resonator holder for holding the resonator;

using a frame to support the resonator holder and the resonator assembly in alignment; and applying a methyl-cyanoacrylate adhesive locking mechanism between the resonator holder and the frame to lock into position the properly aligned resonator assembly, the locking mechanism having six degrees of freedom of adjustment.

8. A method for locking an ink jet resonator assembly as claimed in claim 7 wherein the six degrees of freedom of adjustment comprise:

a. a first degree of freedom of translation;

b. a second degree of freedom of translation;

c. a third degree of freedom of translation;

d. a first degree of freedom of rotation;

e. a second degree of freedom of rotation; and f. a third degree of freedom of rotation.

9. A method for locking an ink jet resonator assembly as claimed in claim 8 further comprising the step of freely translating the six degrees of freedom of adjustment.

10. A method for locking an ink jet resonator assembly as claimed in claim 8 further comprising the step of simultaneously freezing into position all six degrees of freedom of adjustment.

* * * * *